United States Patent [19]

Henn et al.

[11] Patent Number: 4,612,836

[45] Date of Patent: Sep. 23, 1986

[54] ADJUSTABLE SLICING MACHINE FOR BREAD AND OTHER TYPES OF FOODSTUFFS

[75] Inventors: Stefan Henn; Norbert Flammann, both of Solingen, Fed. Rep. of Germany

[73] Assignee: Robert Krups Stiftung & Co. KG., Solingen, Fed. Rep. of Germany

[21] Appl. No.: 665,366

[22] Filed: Oct. 26, 1984

[30] Foreign Application Priority Data

Nov. 14, 1983 [DE] Fed. Rep. of Germany ..... 3341206

[51] Int. Cl.[4] ..... B26D 4/28

[52] U.S. Cl. ..... 83/729; 83/700; 83/719

[58] Field of Search ..... 83/700, 707, 713–731, 83/767, 768

[56] References Cited

U.S. PATENT DOCUMENTS

| | | | |
|---|---|---|---|
| 1,889,539 | 11/1932 | Campbell | 83/707 |
| 1,960,422 | 5/1934 | Van Berkel | 83/707 |
| 4,246,821 | 1/1981 | Fuse | 83/707 |
| 4,273,013 | 6/1981 | Artin et al. | 83/707 |

*Primary Examiner*—Frank T. Yost

*Assistant Examiner*—Hien H. Phan

*Attorney, Agent, or Firm*—Peter K. Kontler

[57] ABSTRACT

A household slicing machine wherein a disc-shaped knife can be driven to rotate in a first vertical plane and a stop for the foodstuff to be sliced is mounted in the housing in a second vertical plane which is parallel to the first plane. The stop is shiftable at right angles to the first plane to change the thickness of the slices and the adjusting device which shifts the stop relative to the knife has a pair of coaxial sleeves rotatably mounted on the stop and defining a helical path having several sections with different leads. A stationary carrier is provided on a working platform in front of the support and has a follower which extends into the helical path. The extent to which the stop moves relative to the plane of the knife in response to rotation of the sleeves through a given angle depends on that section of the helical path which is being tracked by the follower so that the operator can effect highly accurate or coarser adjustments of the distance between the plane of the stop and the plane of the knife by rotating the sleeves through one and the same angle. The follower tracks a path section of less pronounced lead when the two planes are close to each other.

19 Claims, 18 Drawing Figures

FIG.13
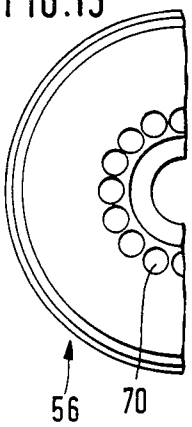
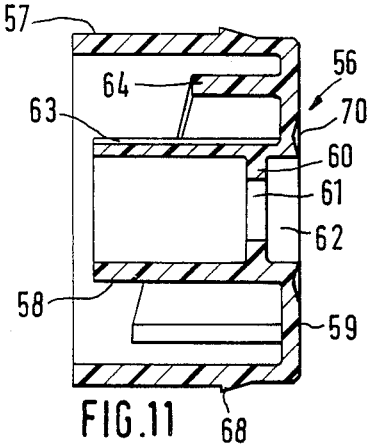
FIG.11
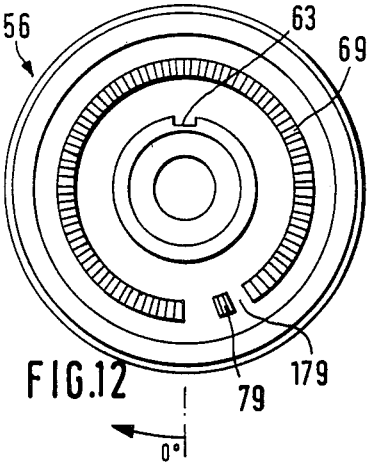
FIG.12
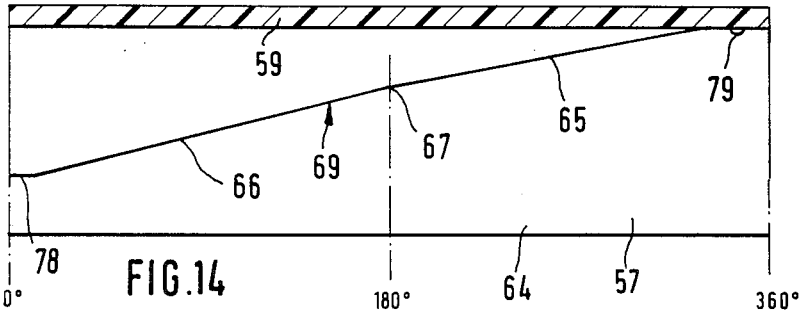
FIG.14
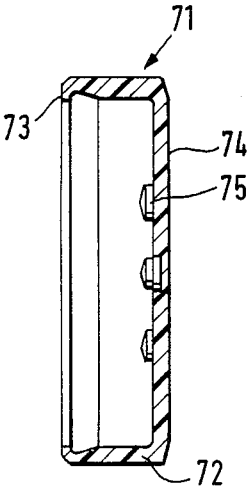
FIG.15
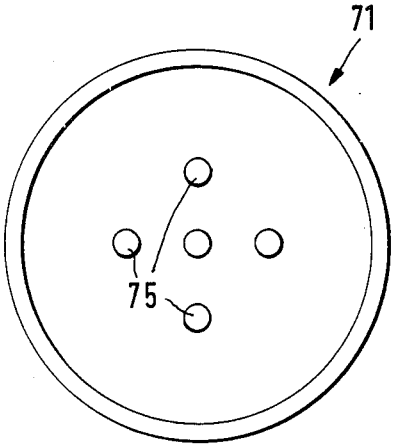
FIG.16

ADJUSTABLE SLICING MACHINE FOR BREAD AND OTHER TYPES OF FOODSTUFFS

CROSS-REFERENCE TO RELATED CASES

The appliance which is disclosed in the present application is or can be identical with the appliance described in the commonly owned copending patent application Ser. No. 664,976 filed Oct. 26, 1984 by Norbert FLAMMANN et al. for "Adjustable household slicing machine". Furthermore, the appliance which is disclosed in the present application is similar to the appliance which is described and shown in the commonly owned copending patent application Ser. No. 665,128 filed Oct. 26, 1984 by Norbert Flammann for "Household appliance with an adjustable guard for a rotary tool" and in the commonly owned copending patent application Ser. No. 665,017 filed Oct. 26, 1984 by Norbert Flammann and Edgar Rixen for "Household appliance and an adjustable guard for its tool".

BACKGROUND OF THE INVENTION

The present invention relates to appliances in general, and more particularly to improvements in household slicing machines or analogous appliances which are equipped with means for adjusting the thickness of slices that can be severed from loaves of bread, from rods of salami, from onions and/or from other types of foodstuffs.

Household appliances of the above outlined character normally comprise a motor driven disc-shaped knife which is or which can be located in a vertical plane, and a plate-like stop whose position with reference to the knife can be changed and one side of which serves as an abutment for the foodstuff which is to be sliced. By changing the distance between such one side of the stop and the plane of the knife, the operator can select the thickness of the slices with a degree of accuracy which is determined by the adjusting means. The latter normally comprises a stationary nut secured to the housing of the appliance and a rotatable feed screw or the like which is secured to the stop and can be turned by hand in order to make a selection of the thickness of the slices to be severed from a particular foodstuff.

A drawback of presently known appliances of the above outlined character is that the adjusting means for the stop does not allow for a highly accurate selection of the thickness of slices. Thus, the lead of the aforementioned feed screw is constant from end to end so that each angular displacement of the feed screw through a given angle corresponds to one and the same displacement of the stop with reference to the plane of the knife. On the other hand, it is often desirable to select the thickness of slices (e.g., slices of salami) with a high or very high degree of accuracy. The same applies for the slicing of certain types of smoked meat as well as for the slicing of numerous other foodstuffs which should be served or further processed in the form of slices having an accurately determined thickness, especially a minimal thickness. In other words, the versatility of the just discussed conventional appliances is not sufficient to satisfy the needs of housewives, professional or amateur chefs and other persons who are involved with the serving and processing of foods including sliced foods.

OBJECTS AND SUMMARY OF THE INVENTION

An object of the invention is to provide a novel and improved appliance, particularly a household slicing machine, whose versatility greatly exceeds that of the aforedescribed conventional appliances.

Another object of the invention is to provide a novel and improved device for adjusting the position of the mobile stop with reference to the plane of the knife in a slicing machine for bread, meat products, vegetables and the like.

A further object of the invention is to provide a novel and improved stop for use in an appliance of the above outlined character.

An additional object of the invention is to provide the appliance with an adjusting device which can move the stop between a practically infinite number of different positions with reference to the knife and wherein repeated selection of one and the same position of the stop can be effected with a heretofore unmatched degree of reproducibility.

Still another object of the invention is to provide an adjusting device which is not only simple, compact and inexpensive but is also easy to handle and whose manipulation requires a minimum of training and/or explanation.

An additional object of the invention is to provide a novel and improved method of changing the position of an adjustable food stop with reference to the knife in a household slicing machine or an analogous appliance.

A further object of the invention is to provide an adjusting device whose constituents can be readily assembled or taken apart without resorting to any tools or with the utilization of rudimentary tools.

An additional object of the invention is to provide an adjusting device which is constructed and assembled in such a way that the operator is informed of one or more selected positions of the stop with reference to the knife even if the appliance is not provided with a graduated scale for visual determination of the momentary position of the stop.

Still another object of the invention is to provide an adjusting device which allows for coarse as well as for highly accurate selection of the thickness of slices.

An additional object of the invention is to provide a household slicing machine which embodies the above outline adjusting device and wherein such adjusting device occupies room that is available anyway so that the adjusting device does not contribute to the bulk of the appliance.

The invention is embodied in an appliance, particularly in a household slicing machine for bread, salami, onions or the like. The appliance comprises a support, a knife which is mounted in the support for rotation in a first plane (for example, the knife can constitute a disc having a serrated peripheral cutting edge and being mounted for rotation in a vertical plane) and a substantially plate-like stop for the material to be sliced. The stop (or at least that surface of the stop which serves as an abutment for the food to be sliced) is located in a second plane which is at least substantially parallel to the first plane, and the appliance further comprises adjusting means which is mounted in part on the stop and in part on the support and serves to move the stop in a direction transversely of (i.e., at right angles to) the first plane to thereby change the thickness of the slices which can be severed from a foodstuff abutting against the aforementioned surface of the stop and being moved relative to the stop toward and along the knife. The adjusting means comprises a first component which defines a helical path including a plurality of sections having different leads and a second component including a follower which extends into the helical path so that, when one of the components is rotated relative to the other component about the axis of the helical path, the extent to which the stop is moved relative to the first plane in response to rotation of the one component through a predetermined angle is determined by that section of the path which is being tracked by the follower. In other words, the operator can rotate the one component through a given angle to effect a greater change in the distance between the two planes and again through the same given angle to effect a lesser change in the distance between the two planes, depending upon the selection of that section of the helical path which is being tracked by the follower.

For example, the helical path can include three sections including two neighboring sections having different leads and a third section whose lead is zero (i.e., the distance between the two planes remains unchanged when the one component is rotated while the follower is located in the third section of the path.

In accordance with a presently preferred embodiment of the invention, the second component is provided on the support (for example, the second component can include a carrier for the follower and such carrier can be removably secured to a working platform which is located in front of the stop and serves to support the foodstuff which is being sliced or which is about to be sliced) and the first component is rotatable relative to the second component. For example, the first component can be installed at that side of the stop which faces away from the working platform and at a locus which is remote from the cutting edge of the knife to further reduce the likelihood of accidental injury to a careless or inexperienced operator.

The stop can be provided with a shaft and the first component can comprise coaxial inner and outer sleeves which are rotatably mounted on the shaft and respectively have first and second cylindrical walls with first and second helical surfaces which are located opposite each other and define the helical path therebetween. Means is preferably provided for holding the sleeves against axial movement relative to the shaft. One of the sleeves (preferably the cylindrical wall of the inner sleeve) is provided with a channel for introduction of the follower into and for withdrawal of the follower from the helical path in response to movement of one of the components in the axial direction of the shaft while the follower registers with the channel.

The cylindrical wall of the outer sleeve can be provided with a substantially axially extending slot and the outer sleeve can be provided with a detent member which is located in such slot and strikes against the follower to thereby yieldably oppose further rotation of the first component relative to the second component until and unless the operator intensifies the application of torque to the first component so that the detent member overcomes the hurdle which is constituted by the follower.

The path section with a less pronounced lead preferably extends along an arc of 180 degrees and the follower is preferably located in such section of the path when the two planes are close to each other so that the operator can accurately select the thickness of relatively thin or very thin slices.

The means for rotating the two sleeves of the first component relative to the aforementioned shaft on the stop can include a cap which is preferably affixed to one of the sleeves, e.g., to the outer sleeve. The sleeves then further comprise means for transmitting torque from the outer sleeve to the inner sleeve. The surfaces which bound the helical path are preferably but need not be serrated so that the teeth or other protuberances on such surfaces ratchet along the stationary follower and each step can represent a given change of the distance between the two planes.

At least one of the two components of the adjusting means is preferably made of a suitable synthetic plastic material, and the same preferably applies for the support and the stop.

The entire helical path need not extend along an arc greater than 360 degrees.

The novel features which are considered as characteristic of the invention are set forth in particular in the appended claims. The improved appliance itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 11 is an axial sectional view of the outer sleeve of the first component of the adjusting means;

FIG. 12 is an end elevational view of the outer sleeve as seen from the left-hand side of FIG. 11;

FIG. 13 is a fragmentary end elevational view of the outer sleeve as seen from the right-hand side of FIG. 11;

FIG. 14 is a developed view of a portion of the outer sleeve;

FIG. 15 is an axial sectional view of a cap which forms part of the first component of the adjusting means and can be used as a means for rotating the sleeves about their common axis;

FIG. 16. is an end elevational view of the cap as seen from the left-hand side of FIG. 15;

DESCRIPTION OF THE PREFERRED EMBODIMENTS

Figure 1:
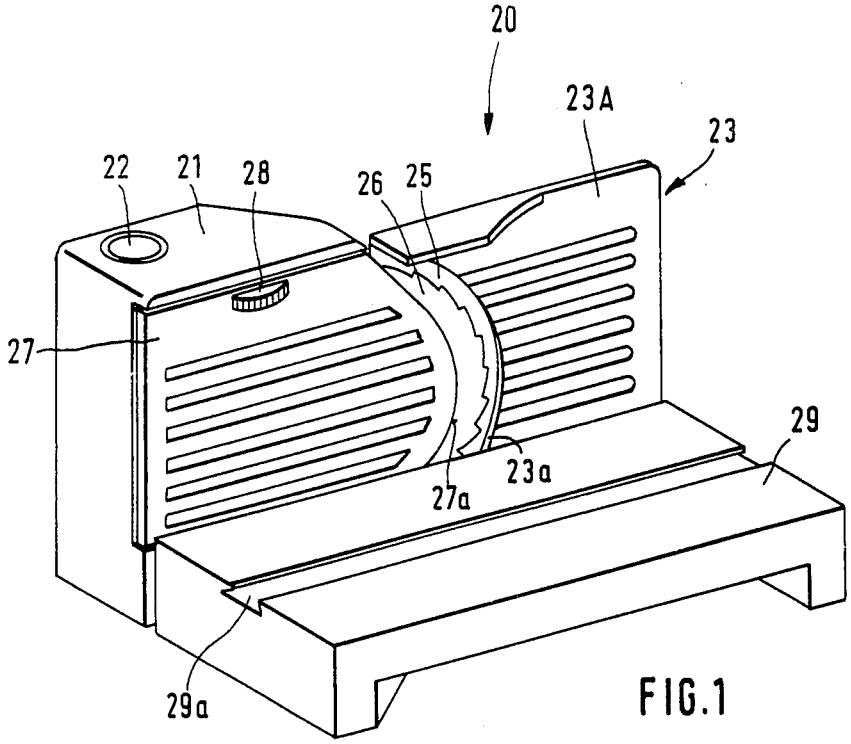
FIG. 1 is a schematic perspective front elevational view of an appliance which constitutes a household slicing machine and embodies the present invention, a portion of the knife being exposed so that the appliance is ready for use.

The drawing shows only those parts of the improved appliance 20 which are necessary for full understanding of the invention. Certain other details of the improved appliance are described and shown in the aforementioned commonly owned copending patent applications Ser. Nos. 665,128 and 665,017 of Flammann (for "Household appliance with an adjustable guard for a rotary tool") and Flammann et al. (for "Household appliance with an adjustable guard for its tool").

Figure 2:
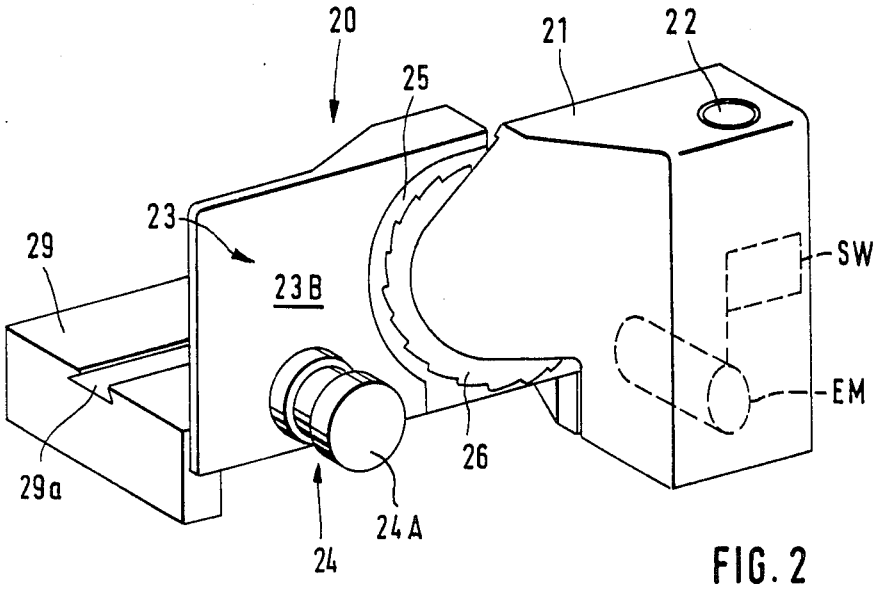
FIG. 2 is a schematic perspective rear elevational view of the appliance, showing the location of the first component of the adjusting means at the rear side the stop.

The appliance 20 which is shown in FIGS. 1 and 2 comprises a housing or support 21 containing an electric motor EM and a switch SW which is in circuit with the motor and can complete such circuit in response to depression of a reciprocable actuating member or trip 22 which is accessible at the top of the housing 21. The housing 21 preferably further contains a variable-speed transmission (not specifically shown) which can transmit torque from the output element of the motor EM to the shaft of a disc-shaped rotary knife 26. The transmission can be adjusted to vary the speed of the knife 26, and the latter is located in a vertical plane and is partially overlapped by an adjustable plate-like one-piece protective shroud or guard 27 which is shiftable relative to the housing 21 in a second vertical plane parallel to the plane of the knife 26. The reference character 28 denotes a handgrip portion which is provided on the guard 27 to facilitate its shifting to a selected position with reference to the housing 21 and knife 26. For example, the guard 27 can be moved to and from the position which is shown in FIG. 1 and in which its convex edge face 27*a* cooperates with the concave edge face 23*a* of a plate-like stop 23 to define an arcuate sickle-shaped slot 25 for the passage of successive slices from the front side toward the rear side of the appliance 20, i.e., successive slices emerge at that side of the appliance which is shown in FIG. 2. The guard 27 is further movable to a second position in which the convex edge face 27*a* is closely adjacent to or actually contacts the concave edge face 23*a* to prevent access to the knife 26 from the front side of the appliance 20, i.e., to reduce the width of the slot 25 to or close to zero.

Still further, the guard 27 is preferably movable to a third position (to the left of the position which is shown in FIG. 1) in which it can be detached from the adjacent front wall of the housing 21. The guard 27 can further serve to prevent depression of the trip 22 (i.e., to prevent completion of the circuit of the motor EM for the knife 26) except when it assumes the position of FIG. 1. All this is fully described in the aforementioned copending applications Ser. Nos. 665,128 and 665,017 of Flammann and Flammann et al.

FIGS. 1 and 2 further show a bridge-like working platform 29 which can constitute a separable or an integral part of the housing or support 21 and whose top surface has an elongated dovetailed groove 29*a* for a reciprocable holder or carriage (not shown) which can be used to facilitate the manipulation of a foodstuff to be sliced, for example, to facilitate the manipulation of small end pieces of sausages, loaves of bread or the like. Other types of attachments can be movably mounted on the working platform 29 and used in the improved appliance 20 with equal or similar advantage.

The stop 23 is a substantially plate like part which is preferably disposed in a vertical plane parallel to the plane of the knife 26 and the entire stop is movable relative to the knife (at right angles to the plane of the knife while its orientation remains unchanged) in order to select the thickness of the slices which can be severed from a foodstuff that abuts against the front side or surface 23A of the stop 23 and is caused to move along the top surface of the platform 29 (i.e., in the longitudinal direction of the groove 29*a*) toward and along the guard 27. The adjusting device 24 which serves to move the stop 23 relative to the plane of the knife 26 is constructed and assembled in accordance with the present invention and comprises two main components, namely a rotatable first component 24A which is detachably mounted at the rear side 23B of the stop 23 and a stationary second component 24B which is removably mounted in the working platform 29. The knife 26 is also separable from the housing 21 for more convenient cleaning, inspection and (when necessary) replacement. For example, the knife 26 can be readily detached from its shaft (or with its shaft) when the guard 27 is removed from the housing 21. Such removal can take place when the guard 27 is moved to the aforementioned third position to the left of the position which is shown in FIG. 1.

Figure 3:
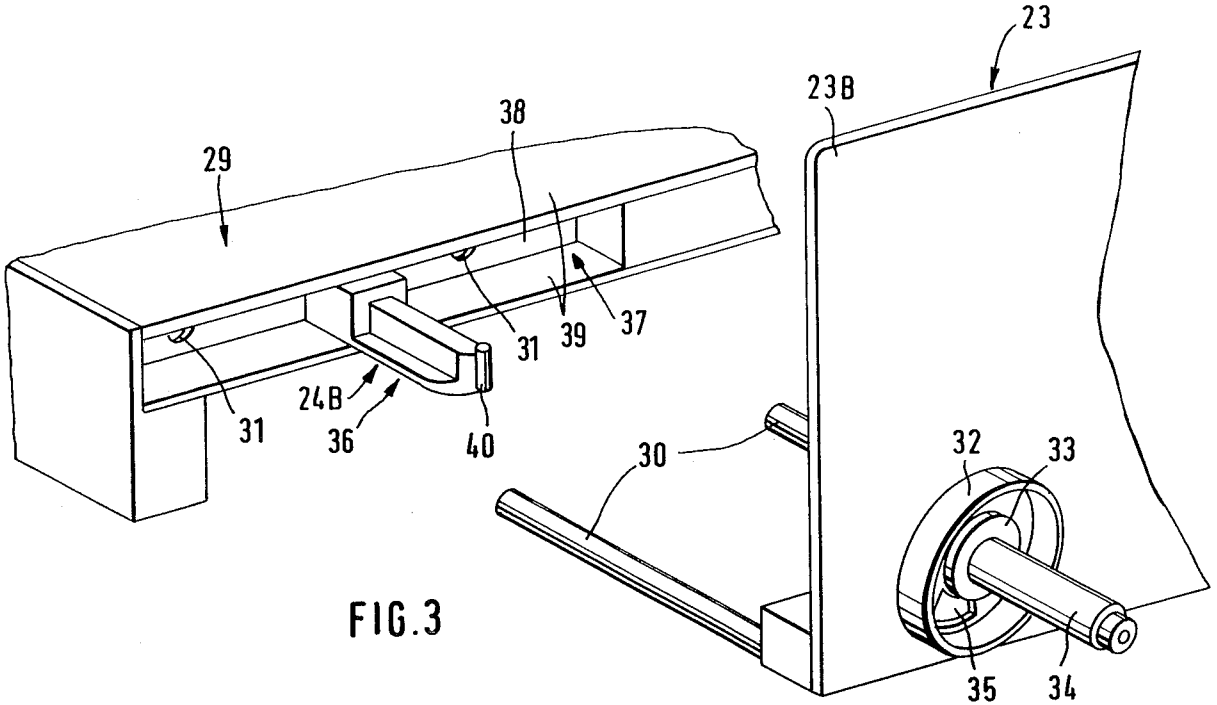
FIG. 3 is an enlarged fragmentary exploded perspective view of the stop and of a working platform which forms part of the support, the second component of the adjusting means, being shown in installed position and the first component of the adjusting means being omitted in order to show those parts of the stop which carry the second component.

When the appliance 20 is fully assembled, the bridge-like working platform 29 is preferably rigidly affixed to the remaining part or parts of the housing 21. However, it is also possible to mount the platform 29 for pivotal movement relative to the remaining part or parts of the housing 21 so that the appliance 20 can be converted into a relatively small package for storage or shipment. The working platform 29 further constitutes a means for guiding the stop 23 in its movements relative to the knife 26 for the purpose of changing the distance between the plane of the front side 23A of the stop and the plane of the circumferentially complete serrated cutting edge of the knife 26. As can be seen in FIG. 3, that side of the working platform 29 which faces the front side 23A of the stop 23 has an elongated recess 37 which is flanked from above and from below by two parallel horizontal sidewalls 39 and at the rear by a bottom wall 38 which is located in a vertical plane. The bottom wall 38 has several openings in the form of circular holes 31 two of which receive portions of two elongated rod-shaped guides 30 affixed to or integral with the lower portion of the stop 23 at a level below that part of the front side 23A which is contacted by foodstuffs when the appliance 20 is in actual use. The walls 38 and 39 constitute a substantially U-shaped enclosure surrounding the recess 37 and receiving a portion of the second component 24B of the adjusting device 24.

Figure 17:
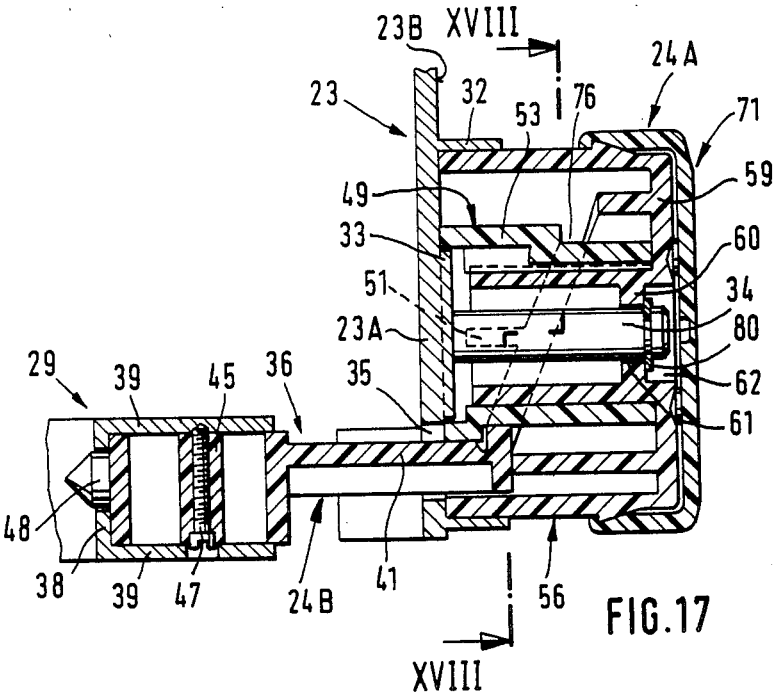
FIG. 17 is a sectional view of the assembled adjusting means and of portions of the support and stop.

The stop 23 has a horizontal stub shaft 34 which is disposed between and is parallel with the guides 30. The shaft 34 extends from the rear side 23B of the stop 23 and is spacedly surrounded by a rather short cylindrical receptacle 32 for the separable first component 24A of the adjusting device 24. As can be seen in FIG. 17, the receptacle 32 constitutes an integral part of the stop 23 and spacedly surrounds a washer-like centering member 33 which is also integral with the stop 23 and surrounds the adjacent portion of the shaft 34. The stop 23 has an arcuate opening or window 35 which is disposed at a level below the shaft 34 between the receptacle 32 and the centering member 33 and permits for insertion of a portion of the second component 24B through the stop and into the interior of the first component 24A.

Figure 4:
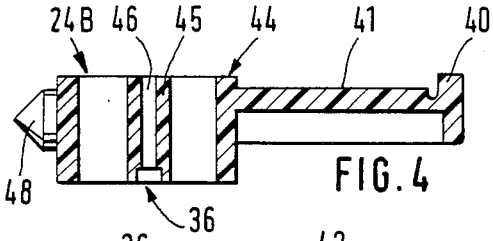
FIG. 4 is a central longitudinal sectional view of the second component of the adjusting means.
Figure 5:
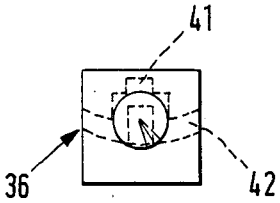
FIG. 5 is an end elevational view of the second component as seen from the left-hand side of FIG. 4.
Figure 6:
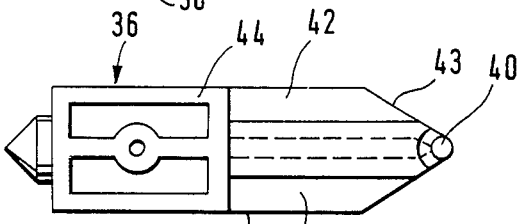
FIG. 6 is a plan view of the second component which is shown in FIGS. 4 and 5.
Figure 9:
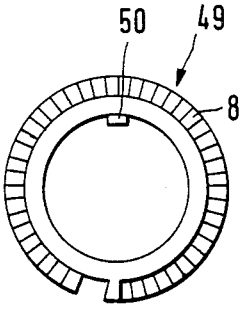
FIG. 9 is an end elevational view of the inner sleeve as seen from the right-hand side of FIG. 7.
Figure 7:
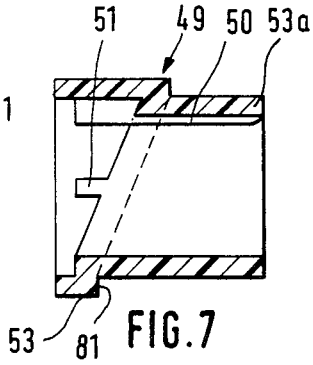
FIG. 7 is an axial sectional view of the inner sleeve of the first component of the adjusting means.
Figure 8:
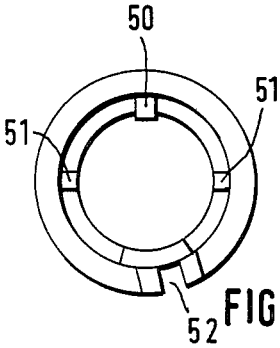
FIG. 8 is an end elevational view of the inner sleeve as seen from the left-hand side of FIG. 7.

The component 24B of the adjusting device 24 has an elongated one-piece holder or carrier 36 for a vertical stud-like follower 40. As can be seen in FIGS. 4 to 6, the follower 40 is integral with the carrier 36. The entire second component 24B can be made from a suitable synthetic plastic material such as DELRIN (trademark). The follower 40 has a circular cross-sectional outline (see FIGS. 3 and 6). The first or front portion 41 of the carrier 36 is integral with the follower 40 and its central part is provided with two laterally extending wings 42 having arcuate cross-sectional outlines (see particularly FIGS. 5 and 18). The front edge faces 43 of the wings 42 taper forwardly toward the follower 40. The lateral edge faces **42*a* of the two wings 42** are parallel to each other.

The enlarged rear or second portion 44 of the carrier 36 may but need not constitute a solid body. In the illustrated embodiment, the rear portion 44 is hollow and is formed with a longitudinally extending vertical partition 45 defining a vertical hole 46 for a screw 47 (shown in FIG. 17) which serves to secure the carrier 36 to one sidewall 39 of the working platform 29 in a manner as shown in FIG. 3, i.e., so that the second component 24B is located substantially midway between the rod-shaped guides 30 of the stop 23. The screw 47 preferably meshes with the lower sidewall 39. That end wall of the enlarged rear portion 44 of the carrier 36 which is remotest from the front portion 41 has an outwardly extending locating stud 48 serving to enter a third opening or hole (not shown) in the bottom wall 38 of the working platform 29 to reliably hold the entire second component 24B in the recess 37. The aforementioned third hole or opening is located substantially or exactly midway between the two openings 31 which are actually shown in FIG. 3. The configuration of the rear portion 44 is such that it cannot rotate in the recess 37, and the stud 48 cooperates with the bottom wall 38 to prevent any shifting of the carrier 36 in the longitudinal direction of the recess 37. Due to such configuration of the portion 44 due to the provision of the stud 48 thereon, a single screw 47 or another suitable fastener suffices to reliably hold the second component 24B in an optimum position with reference to the working platform 29. The pointed tip at the free end of the stud 48 facilitates its insertion into the corresponding opening of the bottom wall 38.

Figure 18:
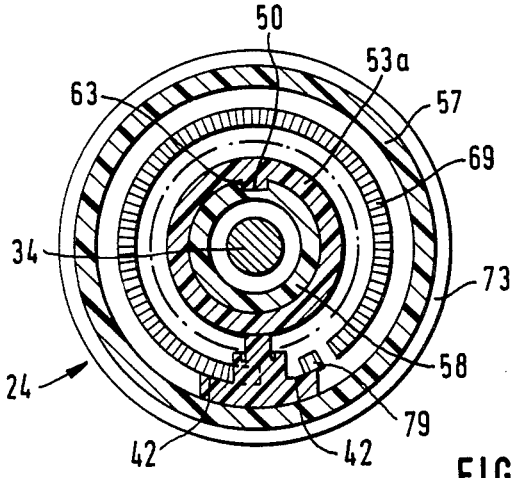
FIG. 18 is a sectional view as seen in the direction of arrows from the line XVIII—XVIII of FIG. 17.

The first component 24A of the adjusting device 24 comprises a cylindrical inner sleeve 49 which is shown in detail in FIGS. 7 to 10 as well as in FIGS. 17 and 18. The entire inner sleeve 49 is preferably made from a single piece of suitable synthetic plastic material, e.g., NOVODUR (trademark), and includes two cylindrical walls 53 and **53*a* having different outer and inner diameters. The axial length of the walls 53 and 53*a* varies, as considered in the circumferential direction of the inner sleeve 49, and the larger-diameter wall 53 has a serrated (e.g., toothed) helical surface 81 at the adjacent end of the smaller-diameter wall 53*a*. The internal surface of the inner sleeve 49 is formed with an axially parallel projection or tongue in the form of an elongated rib 50 extending substantially all the way between the two end faces of the inner sleeve (see particularly FIG. 7). The rib 50 constitutes a means for receiving torque from a second or outer sleeve 56 of the first component 24A**.

Figure 10:
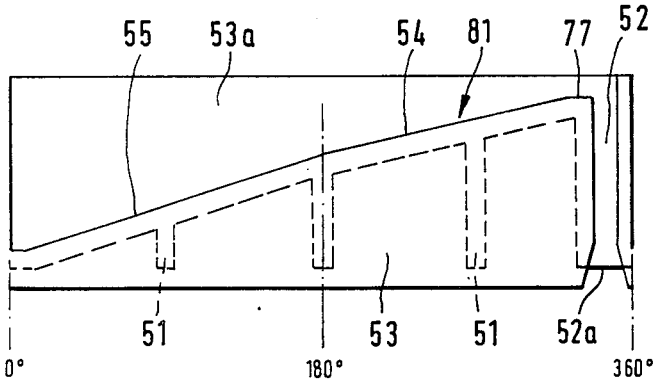
FIG. 10 is a developed view of the inner sleeve.

As can be seen in FIG. 10, the slope or inclination of the helical surface 81 of the cylindrical wall 53 is not constant. Thus, the surface 81 includes a section 54 of lesser inclination and an immediately adjacent section 55 of greater inclination. Still further, the surface 81 has a relatively short section 77 whose inclination is zero, i.e., whose distance from either axial end of the inner sleeve 49 is constant. The reference character 52 denotes an axially parallel channel which is machined into or otherwise formed in the cylindrical wall 53 and terminates at the section 77 of the helical surface 81. The inlet **52*a* of the channel 52 tapers in a manner as shown in FIG. 10 in order to allow for more convenient introduction of a portion of the follower 40. The inner side of the cylindrical wall 53 is further formed with three equidistant centering projections in the form of axially parallel ribs 51 which engage the peripheral surface of and center the inner sleeve 49 on the shaft 34 when the first component 24A is properly mounted at the rear side 23B of the stop 23. The number of centering ribs 51 can be reduced to two or increased to four or more, and such ribs need not be equidistant from one another, as considered in the circumferential direction of the wall 53. The length of the illustrated ribs 51 is not uniform but all of these ribs terminate at the same distance from the open end of the cylindrical wall 53. This provides room for the aforementioned washer-like centering member 33 at the rear side 23B of the stop 23 when the inner sleeve 49 is properly mounted on the shaft 34 and its left-hand end face (as viewed in FIG. 7 or 17) abuts against the rear side 23B immediately adjacent to the periphery of the centering member 33**.

The details of the outer sleeve 56 of the first component 24A are shown in FIGS. 11 to 14 and also in FIGS. 17 and 18. This outer sleeve is preferably a one-piece body made of a suitable synthetic plastic material (e.g., the same as the material of the inner sleeve 46).

The outer sleeve 56 comprises a cylindrical outer wall 57, a cylindrical inner wall 58 which is coaxial with and is spaced apart from the outer wall 57, and a cylindrical intermediate wall 64 which is spaced apart from the walls 57 and 58. The right-hand end portions of the walls 57, 58 and 64 (as viewed in FIG. 11) are integral with a disc-shaped end wall 59 and the peripheral surface of the outer cylindrical wall 57 is formed with a circumferentially complete annular external shoulder 68 which can be engaged by the inwardly extending collar 73 of a snap-on cap 71 shown in FIGS. 15 and 16 and serving to rotate the sleeves 46 and 56 when the operator wishes to change the distance between the plane of the front side 23A of the stop 23 and the plane of the knife 26. The intermediate wall 64 has a serrated helical surface 69 which is located opposite the helical surface 81 of the cylindrical wall 53 when the sleeves 49 and 56 are properly assembled with each other and with the shaft 34 so that the helical surfaces 69 and 81 then define a helical path 76 including three arcuate sections each of which has a different lead. As can be seen in FIG. 14, the helical surface 69 includes a first section 65 having a first inclination, a second section 66 having a more pronounced second inclination and a third section 78 whose inclination is zero, i.e., whose distance from the end wall 59 of the outer sleeve 56 is constant. The reference character 67 denotes in FIG. 14 the locus or junction where the sections 65 and 66 of the helical surface 69 meet. The length of each of the sections 65, 66 approximates 180 degrees, as considered in the circumferential direction of the intermediate wall 64, and the same preferably applies for the sections 54, 55 of the helical surface 81 on the cylindrical wall 53 of the inner sleeve 49. The sections 77 and 78 are located opposite each other adjacent to the channel 52 and define a path section whose lead is zero, i.e., the distance between the plane of the front side 23A of the stop 23 and the plane of the knife 26 does not change when the sleeves 49, 56 are rotated by the cap 71 while the follower 40 is located between the sections 77 and 78 of the helical surfaces 81 and 69.

The central portion 60 of the end wall 59 of the outer sleeve 56 is recessed and has a centrally located hole 61 for a portion of the shaft 34. The central portion 60 defines in the outer side of the end wall 59 a recess or pocket 62 which can receive a retaining device 80 (FIG. 17) serving as a means for holding the sleeves 49 and 56 against axial movement with reference to the shaft 34. The illustrated retaining device 80 is or can constitute a split ring which is inserted into a circumferential groove of the shaft 34 at such a distance from the rear side 23B of the stop 23 that the free end faces of the cylindrical walls 53, 57 abut against the outer side 23B and the free end face of the cylindrical wall 58 abuts against the centering member 33 when the first component 24A is properly mounted on the stop 23.

When the appliance 20 is in actual use, the pressure which a loaf of bread or the like transmits to the front side 23A of the stop 23 is transmitted to the inner sleeve 49 which bears against the inner side of the end wall 59 of the outer sleeve 56. The two sleeves are thus held against axial movement relative to each other, and the split ring 80 ensures that the outer sleeve 56 cannot move axially relative to the shaft 34. The tongue or rib 50 of the inner sleeve 49 extends into an axially parallel external groove 63 of the inner cylindrical wall 58 of the outer sleeve 56 whereby the surface which surrounds the groove 63 serves as a means for transmitting torque to the inner sleeve 49 when the operator decides to turn the cap 71 in a clockwise or in a counterclockwise direction, i.e., the sleeves 49 and 56 of the properly assembled first component 24A invariably rotate as a unit.

The intermediate cylindrical wall 64 of the outer sleeve 56 is formed with a substantially axially parallel slot or cutout 179 which extends all the way to the inner side of the end wall 59 (see FIGS. 12 and 14) and contains a relatively small projection or detent 79 which can engage the follower 40 when the latter is disposed in the aforementioned helical path 76 between the helical surfaces 81 and 69. The person rotating the knob 71 notices that the resistance to turning of the knob 71 increases and such person is thereby informed that the follower 40 is located at the one or the other end of the helical path 76 which is defined by the cylindrical walls 53 and 64. Moreover, the person turning the knob 71 is informed that the projection 79 must move over the follower 40 before the latter registers with the adjacent end of the channel 52 and can be extracted from the first component 24A. In other words, the stop 23 can be separated from the working platform 29 when the projection 79 has been moved over the stationary follower 40 so that the latter is in register with the channel 52 in the cylindrical wall 53 of the inner sleeve 49.

FIGS. 11 and 13 show that the outer side of the end wall 59 of the outer sleeve 56 has an annulus of closely adjacent circular depressions 70 which surround the pocket 62 and are disposed at the same radial distance from the axis of the outer sleeve 56 as the complementary protuberances 75 at the inner side of the top wall or end wall 74 of the cup-shaped snap-on cap 71. The latter is shown in detail in FIGS. 15 and 16. The surfaces surrounding the depressions 70 in the outer side of the end wall 59 constitute one element of a friction clutch the other component of which are the protuberances 75 of the cap 71. The latter is preferably made of a single piece of suitable synthetic plastic material (e.g., the material of the inner sleeve 49 and/or outer sleeve 56) and comprises a circumferentially extending cylindrical wall 72 extending from the inner side of the bottom wall 74 and carrying at its free end the aforementioned collar 73 which can releasably engage the external shoulder 68 of the cylindrical wall 57 of the outer sleeve 56. At such time, the protuberances 75 extend into the adjacent depressions 70 and thus ensure that the outer sleeve 56 normally rotates about the axis of the shaft 34 in response to rotation of the cap 71. However, if the outer sleeve 56 offers a predetermined maximum permissible resistance to rotation, the cap 71 begins to turn relative to the end wall 59 and the protuberances 75 simply ride over the ridges between the closely adjacent neighboring depressions 70. The provision of the just discussed friction clutch is desirable and advantageous because the clutch reduces the likelihood of damage to the first component 24A when the stop 23 reaches a selected end position and should not move further away from or nearer to the plane of the knife 26, depending upon the end position of the stop. It has been found that four eguidistant protuberances 75 normally suffice to ensure proper functioning of the friction clutch.

The sections 54 and 65 of the surfaces 81 and 69 define a first section of the aforementioned helical path 76, and the lead of this section is less pronounced than the lead of the path section between the sections 55 and 66. The follower 40 preferably extends into the path section betWeen the surfaces 54, 65 when the plane of the front side 23A of the stop 23 is rather close to the plane of the knife 26 so that the operator can select the thickness of relatively thin slices with a much higher degree of accuracy than the thickness of the relatively thick slices. For example, the follower 40 will be located between the surface sections 55, 66 when the operator wishes to slice a loaf of bread because the exact thickness of a slice of bread is normally immaterial. On the other hand, if the user wishes to make very thin slices of salami or smoked ham, exact selection of the thickness of each slice is much more important or desirable.

FIGS. 17 and 18 show a portion of the stop 23, a portion of the working platform 29, and the components 24A, 24B of the adjusting device 24 in fully assembled condition. The free end face of the outer cylindrical wall 57 of the outer sleeve 56 abuts against the rear side 23B of the stop 23 and this wall 57 is immediately adjacent to the inner side of the receptacle 32. The shaft 34 extends through the central opening 61 in the recessed portion 60 of the end wall 59 of the outer sleeve 56 and its circumferential groove receives the split ring 80 to hold the sleeves 49 and 56 against axial movement away from the stop 23. The free end of the shaft 34 is located in the pocket 62 so that the shaft does not interfere with the attachment of the cap 71 to the outer sleeve 56. The rib 50 of the inner sleeYe 49 extends into the groove 63 of the inner cylindrical wall 58 so that the sleeves 49 and 56 are compelled to rotate as a unit as soon as long as the user turns the cap 71.

The wall 53 of the inner sleeve 49 surrounds the centering member 33 which thereby centers the inner sleeve 49 with reference to the shaft 34, and the free end face of the cylindrical wall 53 abuts against the rear side 23B of the stop 23. The free end face of the cylindrical wall 53*a* of the inner sleeve 49 abuts against the inner side of the end wall 59 of the outer sleeve 56. The helical surfaces 81 and 69 of the walls 53 and 64 define the aforementioned helical path 76 for the follower 40 on the carrier 36 which latter is affixed to the working platform 29 in a manner as described in connection with FIG. 3. The arcuate wings 42 of the front portion 41 of the carrier 36 are received between the cylindrical walls 57 and 64 of the outer sleeve 56. The curvature of these wings matches that of the adjacent surfaces of the cylindrical walls 57 and 64. The upper side of the front portion 41, as viewed in FIG. 17, abuts against the external surface of the wall 53 of the inner sleeve 49. Such dimensioning of the front portion 41 ensures proper guidance of the sleeves 49 and 56 when they are caused to turn with the cap 71.

The channel 52 in the wall 53 is preferably moved into register with the follower 70 in the zero angular position of the inner sleeve 49, e.g., in that angular position when the stop 23 is located in the one or the other end position. The stop 23 is then free to move in a direction away from the working platform 29 and can be fully detached from other parts of the appliance 20, e.g., for the purposes of cleaning. The rod-shaped guides 30 of the stop 23 then simply slide in the respective holes 31 of the bottom wall 38 and the window 35 of the stop 23 moves relative to the second component 24B which latter remains attached to the platform 29. Reassembly of the stop 23 with the working platform 29, and hence a reengagement of the first component 24A with the second component 24B, is effected by reversing the just described sequence of steps.

The improved appliance is susceptible of many additional modifications without departing from the spirit of the invention. For example, the configuration of the sleeves 49 and 56 can be varied as long as they can define a helical path for the follower 40, most preferably a helical path having sections with different leads to thus allow for highly accurate selection of the thickness of the slices during certain stages of rotation of the first component 24A relative to the second component 24B. Moreover, the component 24A can be mounted on the support of the appliance 20 and the component 24B is then mounted on the stop 23. The slope of the mutually inclined sections of the helical surfaces 81 and 69 can be changed within a wide range, depending upon the intended use of the appliance 20 and on the desired degree of accuracy with which the thickness of the slices is to be selected. Still further, the sections 54, 55, 77 of the helical surface 81 and the sections 65, 66, 79 of the helical surface 69 need not be straight. For example, the sections of the helical surface 81 can be slightly concave and the sections of the helical surface 69 can be slightly convex or vice versa. The number of mutually inclined sections on the helical surfaces 81 and 69 can be increased to four or more or reduced to a mere two. If one of the helical surfaces 81, 69 is concave and the other of these surfaces is convex, the arrangement is preferably such that the rearwardly facing surface 81 of the cylindrical wall 53 is convex.

The transition from helical surface sections of lesser inclination to helical surface sections of greater inclination should not be too pronounced because this could cause the follower 40 to jam at the locations (junctions) where such mutually inclined sections of the surfaces bounding the helical path 76 meet. An elongated cylindrical follower has been found to be ideally suited for use in the improved adjusting device.

The assembly of the first component 24A from two sleeve like parts 49 and 56 is desirable and advantageous because this simplifies the making of helical surfaces 81 and 69 which define the helical path 76. The length of various sections of the helical path 76 need not be the same. Such freedom in selecting the inclination and/or length of various sections of the helical surfaces 81 and 69 is available due to the fact that the sleeves 49 and 56 are two separately produced relatively simple parts which can be mass-produced in available plastic-processing machines and that their helical surfaces 81 and 69 are fully exposed prior to assembly into the first component 24A. Since the components 24A and 24B are readily detachable from the respective parts 29 and 23 of the appliance, the latter can be furnished with two or more adjusting devices 24 each of which allows for a different selection of the thickness of the slices which are formed by the knife 26. Also, the diameters of the followers 40 can vary from adjusting device to adjusting device if the appliance is furnished with two or more adjusting devices.

As mentioned above, the sections 54, 55 and 65, 66 of the respective helical surfaces 81 and 69 can extend along arcs of approximately 180 degrees, as considered in the circumferential direction of the respective sleeves 49 and 56. The section which defines the path section of lesser lead is preferably adjacent to that portion of the helical path 76 in which the follower 40 is located when the distance between the plane of the front side 23A of the stop 23 and the plane of the normally thin or extremely thin knife 26 is zero or close to zero. This ensures that the thickness of the relatively thin slices can be selected with a higher degree of accuracy than the thickness of the relatively thick slices. The user of the appliance 20 learns quickly that the first half revolution of the cap 71 from the zero position of the first component 24A precedes the making of thin slices whose thickness can be selected with a very high degree of accuracy because the cap 71 must be turned through a relatively large angle in order to effect a small or extremely small change in the distance between the plane of the front side 23A of the stop 23 and the plane of the knife 26, and that the second half of the revolution of the cap 71 from zero position involves preparation of the appliance for the making of relatively thick slices.

The provision of the channel 52 is desirable and advantageous because it allows for convenient separation of the stop 23 from other parts of the appliance for the purposes of inspection, cleaning or storage. The provision of the projection 79 in the slot 179 of the cylindrical wall 64 is desirable and advantageous because this projection can be provided at a location such that it moves into engagement with the follower 40 when the distance between the plane of the front side 23A and the plane of the knife 26 is at a minimum or zero. This warns the operator that the first component 24A has been moved close to an angular position in which the stop 23 can be separated from the platform 29. All that is necessary is to cause the projection 79 to move over the follower 40 whereby the channel 52 registers with the follower and the stop 23 can be detached from the platform 29.

The component 24A of the adjusting device 24 can be furnished with a single outer sleeve 56 and with two or more inner sleeves 49 having different axial lengths or vice versa. This renders it possible to change the width of the helical path 76 in order to allow for use of two or more components 24B with followers 40 having different diameters.

The provision of tapering edge faces 43 on the wings 42 of the front portion 41 of the carrier 36 facilitates insertion of this carrier into the first component 24A, and the aforediscussed curvature of the wings 42 enables them to adequately guide the outer sleeve 56 during rotation with reference to the carrier 36. The cost of the second component 24B is low because it is preferably made of a single piece of suitable synthetic plastic material.

An important advantage of the friction clutch including the protuberances 75 of the cap 71 is that it greatly reduces the likelihood of damage to the adjusting device 24 when the user wishes to turn the sleeves 49, 56 beyond the one or the other end position, i.e., when the front side 23A of the stop 23 is located at a maximum distance from the plane of the knife 26 or in the other end position. The wall 72 of the cap 71 surrounds a major part of the exposed portion of the outer sleeve 56 so that it is invariably gripped by the person who wishes to rotate the sleeves 49, 56 in a clockwise or in a counterclockwise direction. This ensures that the friction clutch including the protuberances 75 becomes effective whenever the need for such friction clutch arises. This, in turn, ensures that the user cannot apply to the sleeves 49, 56 of the component 24A (and hence to the component 24B) any forces which could result in damage to or in complete destruction of the adjusting device 24. The exact magnitude of forces which are needed to turn the cap 71 relative to the outer sleeve 56 can be selected by the manufacturer in dependency on the dimensions, material and other characteristics of the parts of the adjusting device 24.

It is clear that the illustrated friction clutch is but one of many types of friction clutches which can be used in the improved adjusting device. The illustrated friction clutch is preferred at this time due to its simplicity because its parts can be formed simultaneously with the making of the outer sleeve 56 and cap 71. The same holds true for the means (shoulder 68 and collar 73) for releasably coupling the cap 71 to the outer sleeve 56, i.e., the shoulder 68 and the collar 73 can be formed simultaneously with the making of the respective parts 56, 71 in a suitable plastic processing machine of any known design.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An appliance, particularly a household slicing machine, comprising a support; a knife mounted in said support for rotation in a first plane; a stop for the material to be sliced, said stop being located in a second plane which is at least substantially parallel to said first plane; and adjusting means mounted in part on said support and in part on said stop and arranged to move said stop in a direction transversely of said first plane, said adjusting means including a first component defining a helical path including a plurality of sections having different leads and a second component including a follower extending into said path so that, when one of said components is rotated relative to the other of said components, the extent to which said stop is moved relative to said first plane in response to rotation of said one component through a predetermined angle is determined by that section of the path which is being tracked by said follower.

2. The appliance of claim 1, wherein said sections include two neighboring sections having different leads.

3. The appliance of claim 1, wherein said second component is provided on said support and said first component is provided on said stop.

4. The appliance of claim 3, wherein said first component is rotatable relative to said second component.

5. The appliance of claim 4, wherein said stop comprises a shaft and said first component includes coaxial inner and outer sleeves rotatably mounted on said shaft, said inner and outer sleeves respectively having first and second cylindrical walls respectively having first and second helical surfaces defining said path, said second component further comprising a carrier for said follower, said carrier being affixed to said support.

6. The appliance of claim 5, further comprising retaining means for holding said sleeves against axial movement relative to said shaft.

7. The appliance of claim 5, wherein said support includes a working platform and further comprising means for releasably securing said carrier to said platform.

8. The appliance of claim 5, wherein one of said sleeves has a channel for introduction of said follower into and for withdrawal of said follower from said path in response to movement of one of said components relative to the other of said components in the axial direction of said shaft while said follower registers with said channel.

9. The appliance of claim 8, wherein said channel is provided in the cylindrical wall of said inner sleeve.

10. The appliance of claim 5, wherein the cylindrical wall of said outer sleeve has a substantially axially extending slot and said outer sleeve includes a detent member provided in said slot and arranged to strike against said follower and to thereby yieldably oppose further rotation of said first component relative to said second component.

11. The appliance of claim 1, wherein said sections include a first section having a first lead and a second section immediately adjacent to said first section and having a more pronounced second lead, said first section extending along an arc of approximately 180 degrees.

12. The appliance of claim 1, wherein said sections include a section whose lead equals or approximates zero.

13. The appliance of claim 1, wherein said first component is rotatably mounted on said stop and includes a pair of coaxial sleeves defining said helical path, means for rotatably supporting said sleeves on said stop, and means for rotating said sleeves relative to said stop including a cap and means for separably affixing said cap to one of said sleeves.

14. The appliance of claim 13, further comprising means for transmitting torque from said one sleeve to the other of said sleeves.

15. The appliance of claim 1, wherein said first component has serrated surfaces bounding said helical path.

16. The appliance of claim 1, wherein said planes are substantially vertical.

17. The appliance of claim 1, wherein at least one of said components consists of a synthetic plastic material.

18. The appliance of claim 1, wherein said helical path extends along an arc of approximately 360 degrees.

19. The appliance of claim 18, wherein said path includes more than two sections.

* * * * *